US007416473B2

(12) United States Patent
Belli et al.

(10) Patent No.: US 7,416,473 B2
(45) Date of Patent: Aug. 26, 2008

(54) NUMERIC-CONTROL WORK-CENTRE FOR MACHINING PLATES OF GLASS, STONE, MARBLE OR THE LIKE, WITH TWO OR MORE MACHINING HEADS

(75) Inventors: Marco Belli, Saltara (IT); Marco Frongia, Pesaro (IT); Filippo Bindelli, Pesaro (IT)

(73) Assignee: Biesse S.p.A., Pesaro (IT)

( * ) Notice: Subject to any disclaimer, the term of this patent is extended or adjusted under 35 U.S.C. 154(b) by 0 days.

(21) Appl. No.: 11/585,908

(22) Filed: Oct. 25, 2006

(65) Prior Publication Data

US 2007/0099543 A1 May 3, 2007

(30) Foreign Application Priority Data

Oct. 27, 2005 (IT) ..... TO2005A0765

(51) Int. Cl.

| | |
|---|---|
| ***B24B 49/00*** | (2006.01) |
| ***B24B 51/00*** | (2006.01) |
| ***B24B 7/00*** | (2006.01) |
| ***B24B 9/00*** | (2006.01) |
| ***B23Q 1/01*** | (2006.01) |
| ***B23C 1/00*** | (2006.01) |
| ***B23C 3/00*** | (2006.01) |
| *B24B 7/30* | (2006.01) |

(52) U.S. Cl. ..... 451/5; 451/8; 451/150; 409/202; 409/192

(58) Field of Classification Search ..... 451/5, 451/8, 11, 160; 409/202, 186–188, 192–195, 409/203, 211–213, 217, 207–209, 53; 408/53
See application file for complete search history.

(56) References Cited

U.S. PATENT DOCUMENTS

| | | | | |
|---|---|---|---|---|
| 3,934,700 | A * | 1/1976 | Schubert et al. | 198/345.3 |
| 3,973,859 | A * | 8/1976 | Huber et al. | 408/12 |
| 5,088,181 | A * | 2/1992 | Jeppsson | 29/563 |
| 5,146,715 | A | 9/1992 | Bando | |
| 5,785,578 | A | 7/1998 | Thoresen et al. | |
| 6,068,431 | A * | 5/2000 | Line | 409/202 |
| 6,099,212 | A * | 8/2000 | Marocco | 408/3 |

(Continued)

FOREIGN PATENT DOCUMENTS

| | | |
|---|---|---|
| DE | 203 18 660 | 2/2004 |

(Continued)

*Primary Examiner*—Joseph J. Hail, III
*Assistant Examiner*—Alvin J. Grant
(74) *Attorney, Agent, or Firm*—Nixon & Vanderhye P.C.

(57) ABSTRACT

A numeric-control work-centre for machining plates of glass, marble and natural or synthetic stones comprises: a bench, defining a work surface, designed to receive the plates to be machined; two fixed side members, set at the two sides of the work surface; an overhead cross-member, guided over the two side members like an overhead-travelling crane, in a horizontal direction Y orthogonal to the horizontal direction X of the cross-member; and a carriage, which is mobile in the aforesaid horizontal direction X on the cross-member, present in which are two work heads carried by a slide, mounted on the carriage so that, during machining of the edge of a plate, consecutive passing of the first tool and of the second tool in any order is obtained with one and the same movement of the carriage and/or of the cross-member of the work-centre.

18 Claims, 6 Drawing Sheets

U.S. PATENT DOCUMENTS

| | | | | |
|---|---|---|---|---|
| 6,228,007 | B1 * | 5/2001 | Quak et al. | 483/56 |
| 6,568,885 | B2 * | 5/2003 | Green | 409/134 |
| 6,623,219 | B2 * | 9/2003 | Nagasawa et al. | 408/43 |
| 6,920,679 | B2 * | 7/2005 | Hessbruggen et al. | 29/563 |
| 7,150,706 | B2 * | 12/2006 | Grob | 483/54 |
| 7,172,375 | B2 * | 2/2007 | Tanoue et al. | 409/202 |

FOREIGN PATENT DOCUMENTS

| | | |
|---|---|---|
| EP | 0 673 715 | 9/1995 |
| FR | 1 422 266 | 12/1965 |

* cited by examiner

NUMERIC-CONTROL WORK-CENTRE FOR MACHINING PLATES OF GLASS, STONE, MARBLE OR THE LIKE, WITH TWO OR MORE MACHINING HEADS

SUMMARY OF THE INVENTION

The present invention relates to the field of numeric-control work-centres for machining plates of glass, marble and natural or synthetic stones in general.

In particular, the invention regards a work-centre of the known type comprising:

- a bench, defining a work surface designed to receive plates to be machined;
- two fixed side members set at the two sides of the work surface;
- an overhead cross-member guided over the two side members like an overhead-travelling crane, in a horizontal direction Y orthogonal to the horizontal direction X of the cross-member;
- a carriage, which is mobile in the aforesaid horizontal direction X on the cross-member;
- a first machining head, which is mobile on the carriage in a vertical direction Z and is equipped with a rotating spindle, which can be coupled to a machining tool, and with the corresponding electric driving motor;
- first, second, and third motor means for controlling the cross-member of the carriage and the machining head respectively along the axes Y, X, and Z; and
- electronic means for controlling said first, second, and third motor means and the electric driving motor of the aforesaid spindle.

Work-centres according to the conventional art prove very flexible in so far as they enable execution of different machining operations on plates, but present, however, a relatively low working capacity, which leads to a consequent not very high productivity.

The object of the present invention is to propose a work-centre of the known type referred to at the start of the present description that will enable the aforesaid drawback to be solved with means that are simple, inexpensive and functional in use.

In order to achieve said object, the subject of the invention is a work-centre and a method for machining plates of glass, stone, marble or the like having the characteristics described in the annexed claims.

BRIEF DESCRIPTION OF THE DRAWINGS

Further characteristics and advantages of the present invention will emerge from the ensuing description with reference to the annexed plate of drawings, which is provided purely by way of non-limiting example and in which.

DETAILED DESCRIPTION OF THE INVENTION

Figure 1:
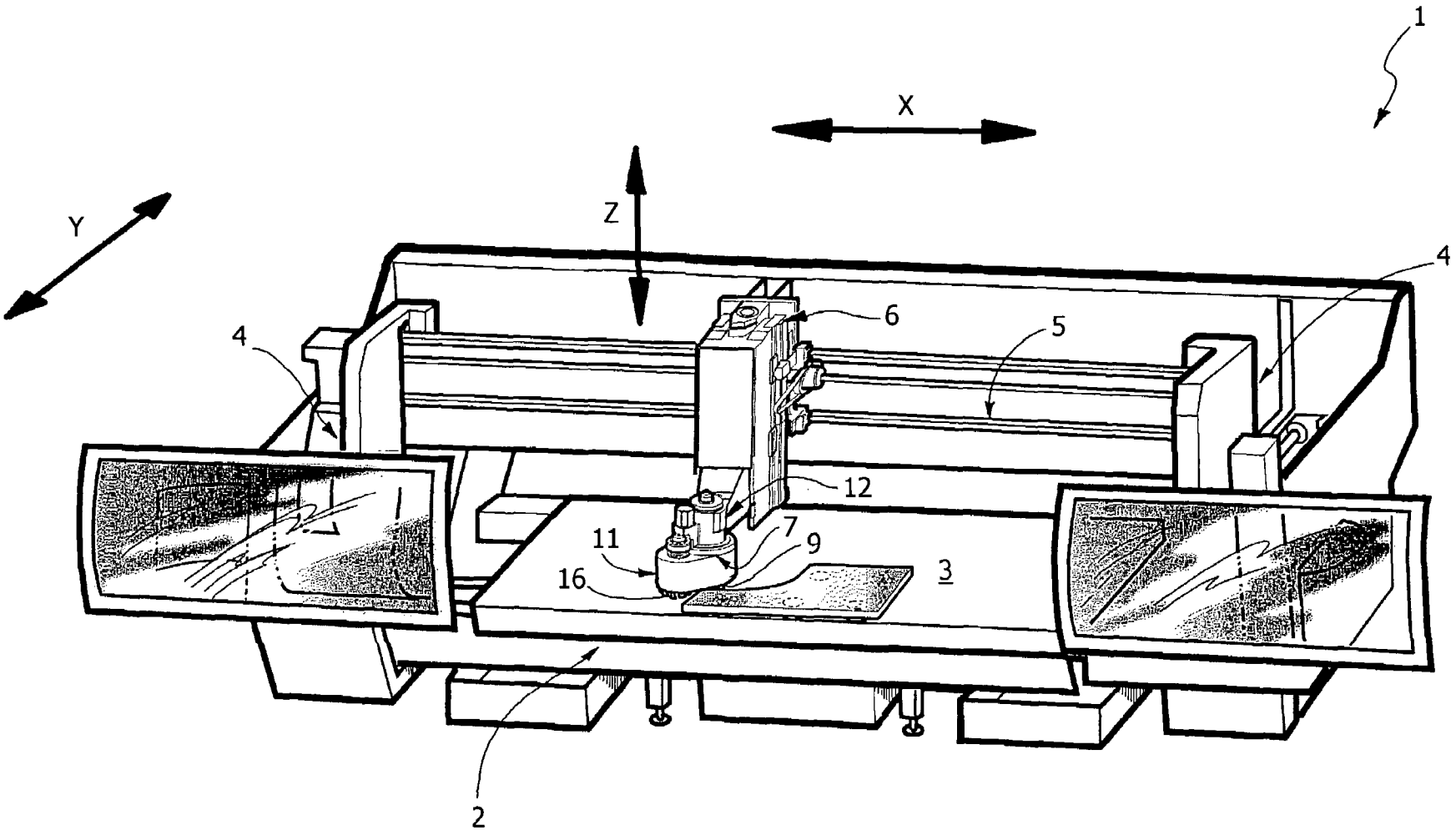
FIG. 1 is an overall view of a work-centre according to the present invention.

With reference to FIG. 1, number 1 designates as a whole a work-centre for machining plates of stone, marble or glass, comprising a machine bench 2, defining a work surface 3, and two fixed side members 4, guided over which is a cross-member 5. The cross-member 5 extends in a horizontal direction X and moves above the two side members 4 in a horizontal direction Y orthogonal to the direction X. A carriage 6 is mounted so that it can slide in the horizontal direction X of the cross-member on the cross-member 5. Mounted on the carriage 6 is a first machining head 7, equipped with a rotating spindle 8, which can be coupled to a machining tool 9. The first machining head 7 moreover carries the corresponding electric driving motor 10 (shown in FIG. 4) for controlling rotation of the rotating spindle 8. The electrospindle is oriented according to a vertical axis A1.

Figure 2:
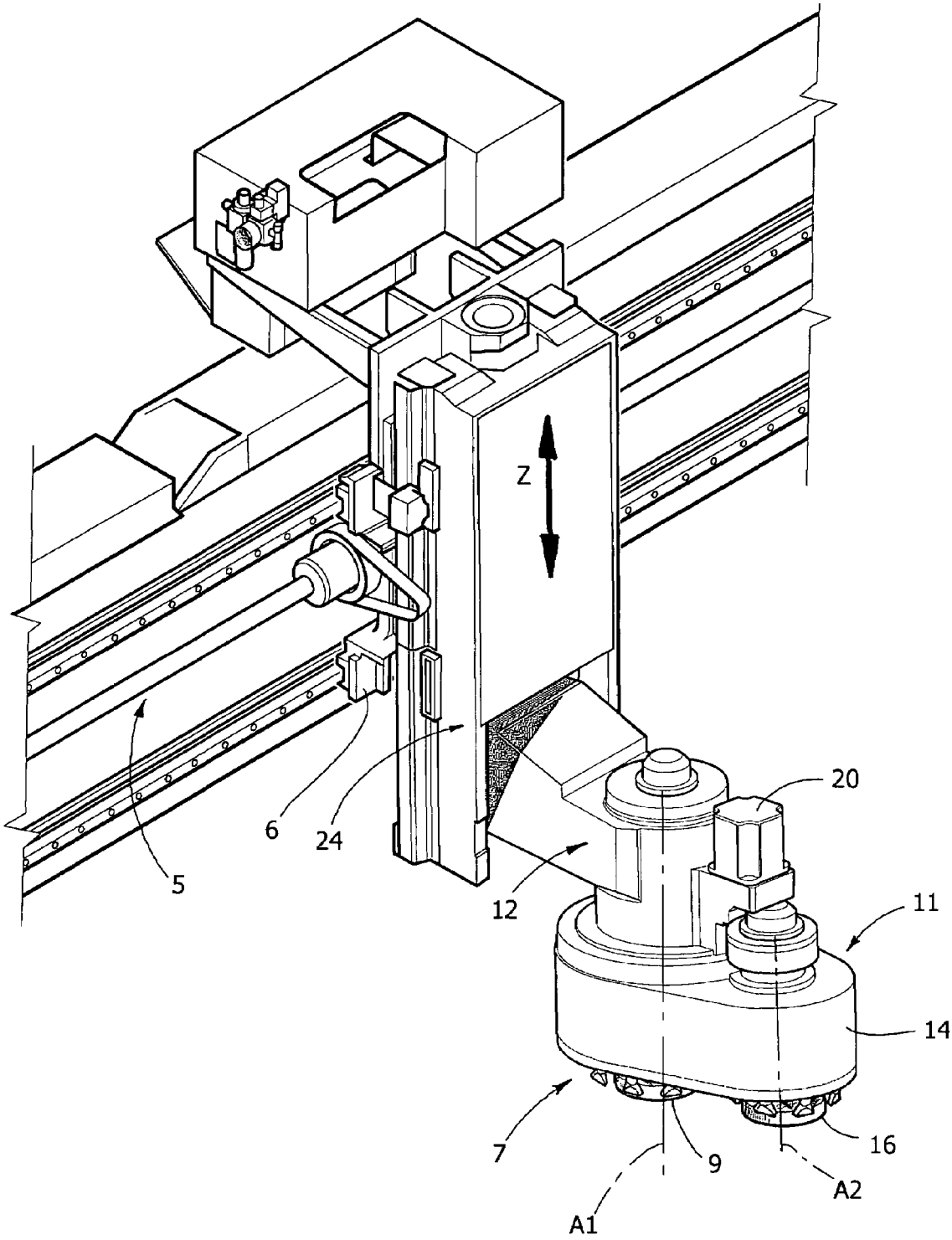
FIG. 2 is an enlarged view of a detail of the work-centre of FIG. 1.

With reference to FIG. 2, the first machining head 7 is carried by a slide 24, with the possibility of movement in a vertical direction Z. In particular, the first machining head 7 is rigidly connected to the slide 24 mounted so that it can slide on the carriage 6 in a vertical direction Z substantially parallel to the axis A1 of the first spindle 8.

In the example illustrated in the figures, the slide 24, mounted on the carriage 6, is moreover provided with a second machining head 11, supported orientably about the axis A1 by the first machining head, in the way that will be described in detail in what follows. The second machining head 11 in turn carries an auxiliary rotating spindle 13 (shown in FIG. 4) having an axis A2 thereof that is substantially parallel and set at a distance from the axis A1 of the first spindle 8 of the first machining head 7. The auxiliary spindle 13 can be coupled to a machining tool 16.

In the present description, the details of construction of the fixed structure of the machine, of the cross-member 5, of the way in which the cross-member 5 is mounted mobile on the fixed structure, of the carriage 6 and of the way in which this is mounted along the cross-member 5, and of the machining heads and of the way in which these are mounted mobile on the carriage 6 are not illustrated in so far as they can be made in any known way and also in so far as they do not, in themselves, fall within the scope of the present invention. The same applies as regards the way in which the movements of the cross-member 5, the carriage 6, and the machining heads are controlled. Said movements, in conformance with the known art, are controlled by means of respective electric motors and drives (for example, of the internal-screw/external-screw type). Furthermore, once again in conformance with the known art, the electric motors that drive the various mobile parts of the work-centre are controlled by electronic control means programmable for enabling execution of predetermined machining cycles on the plates to be machined. Said plates are positioned on the work surface 3 and fixed there by clamping means of any known type, for example, by means of suction blocks designed to withhold the plates by negative pressure.

The term "electrospindle" is herein used to indicate the assembly constituted by a spindle to which the tool can be coupled, as well as the corresponding electric driving motor.

Figure 4:
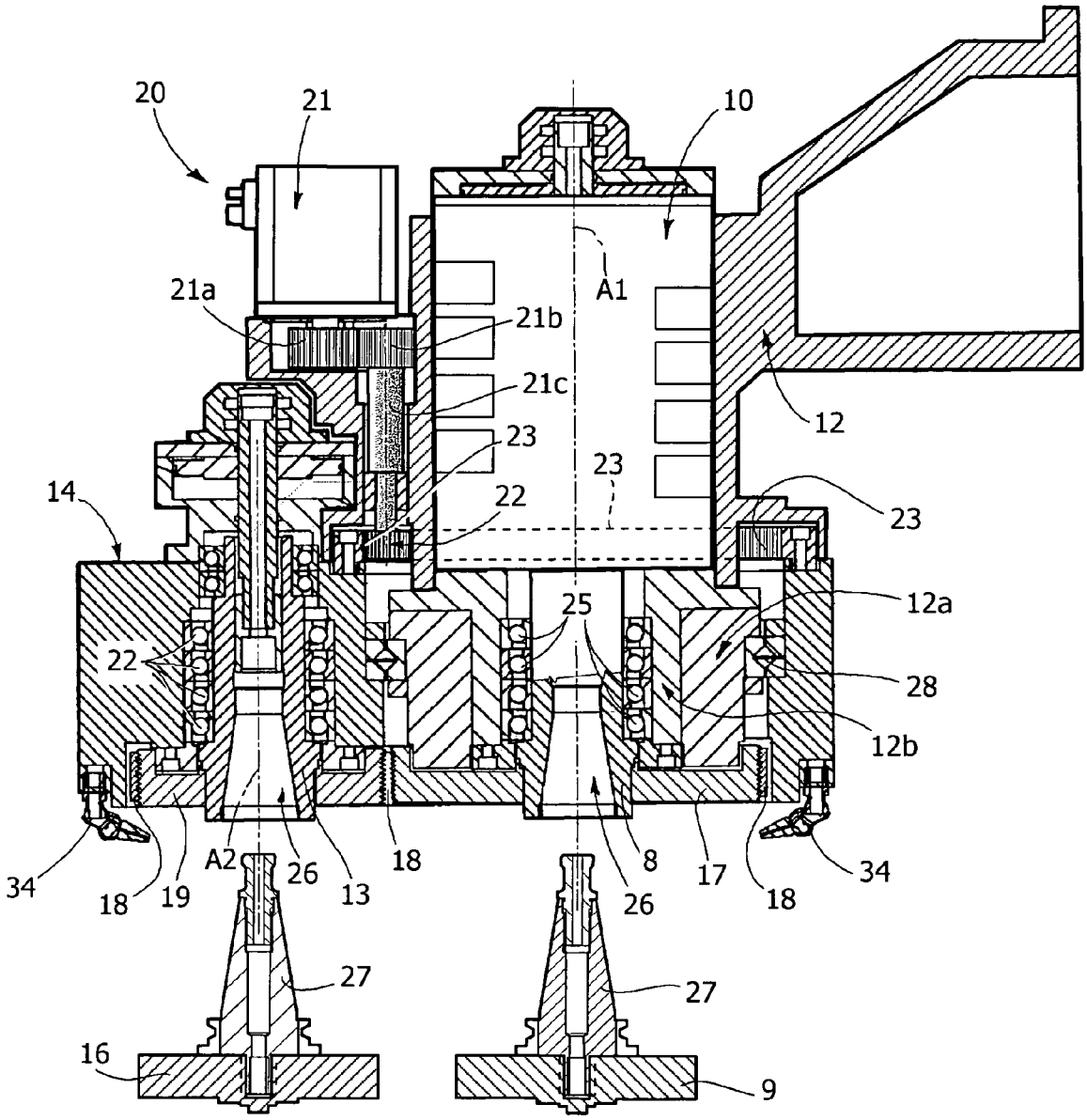
FIG. 4 is a cross-sectional view of the machining heads of FIG. 3.

The machining tool 9 can be coupled to the rotating spindle 8 in any known way, for example by means of a tapered-shank coupling of the type illustrated in FIG. 4. The details of construction of said coupling are not described herein, since, as has been said, they can be made in any known way and in so far as they do not moreover fall, taken in themselves, within the scope of the present invention. The elimination of said details in the drawings moreover renders the latter more readily understandable.

Figure 3:
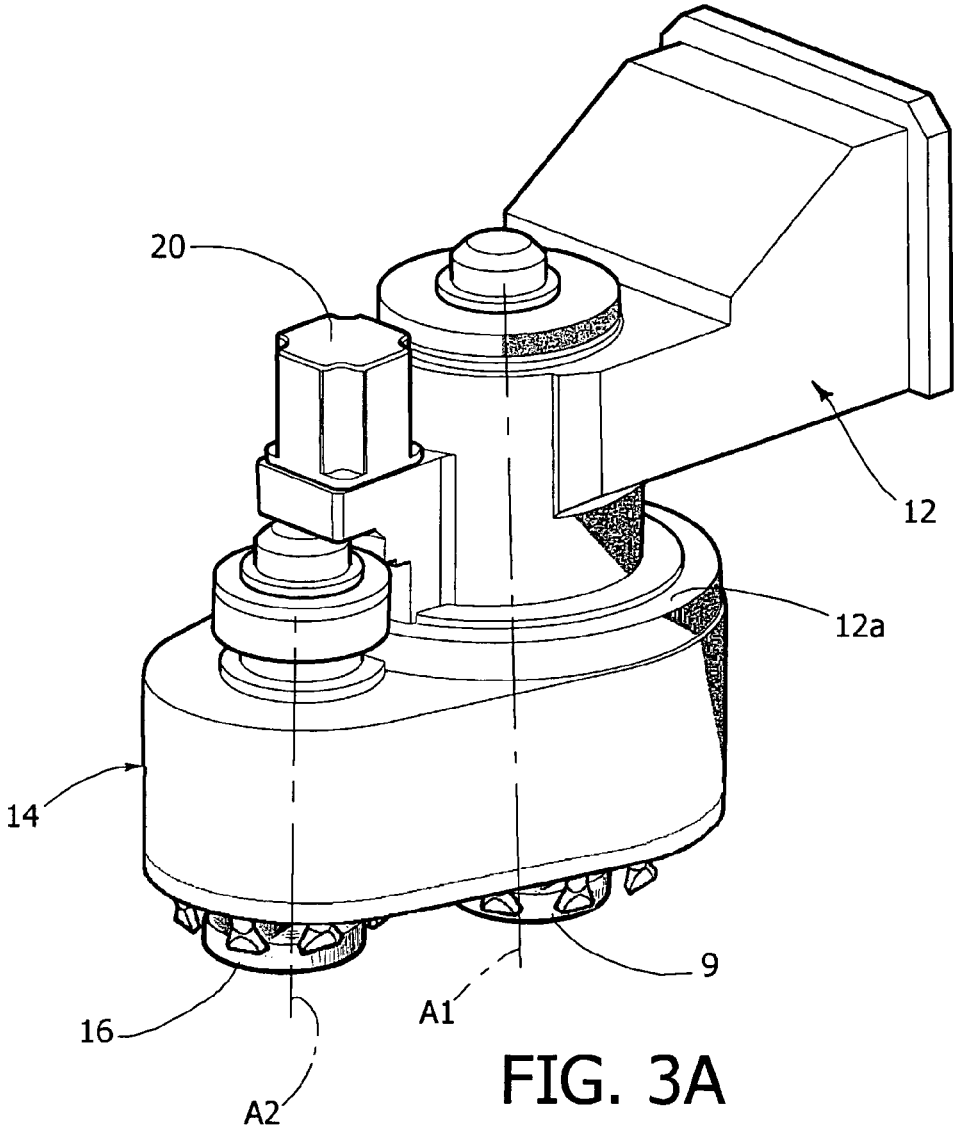
FIG. 3 shows a first version of the machining heads of the work-centre of FIG. 1.

With reference to FIGS. 3 and 4, the first machining head 7 comprises a first supporting structure 12 carried by the slide 24. The first supporting structure 12 carries the electric motor 10 for controlling the first machining tool 9. The spindle 8 turns on rolling bearings 25 within a cylindrical supporting part 12*b* supported in turn by a part 12*a* of the first supporting structure 12. The second machining head 11, which carries the auxiliary spindle 13, comprises an auxiliary supporting part 14 mounted in cantilever fashion on the first supporting structure 12 orientably about the axis A1 of the first spindle 8.

The auxiliary supporting part 14 is mounted orientable about the axis A1 of the first spindle 8 above the cylindrical part 12*b* of the first supporting structure 12 via a rolling bearing 28.

In the example illustrated in FIG. 4, auxiliary motor means 20 are provided, which control the angular position of the second machining head 11 with respect to the axis A1. Said auxiliary motor means 20 are also controlled by the aforesaid electronic control means so that, during machining of the edge of a plate of glass, the consecutive passing of the auxiliary tool 16 and of the first machining tool 9 are obtained along the edge of the plate with the same movement as that of the carriage and/or cross-member of the work-centre.

In this way, with a single pass, it is possible to execute two successive machining operations with two different tools, so reducing considerably the machining-cycle times.

The machining tools used can be of any known type, and in particular can be grinding wheels. It is possible to perform different machining operations that adopt configurations in which the two tools are chosen from among:

diamond grinding wheels;
resinoid grinding wheels;
polishing grinding wheels;
rubber grinding wheels; and
buffing wheels.

In a first embodiment, illustrated in FIG. 4, the means for controlling rotation of the auxiliary spindle 13 comprise a mechanical drive controlled by the electric driving motor 10 of the first spindle 8.

Figure 5:
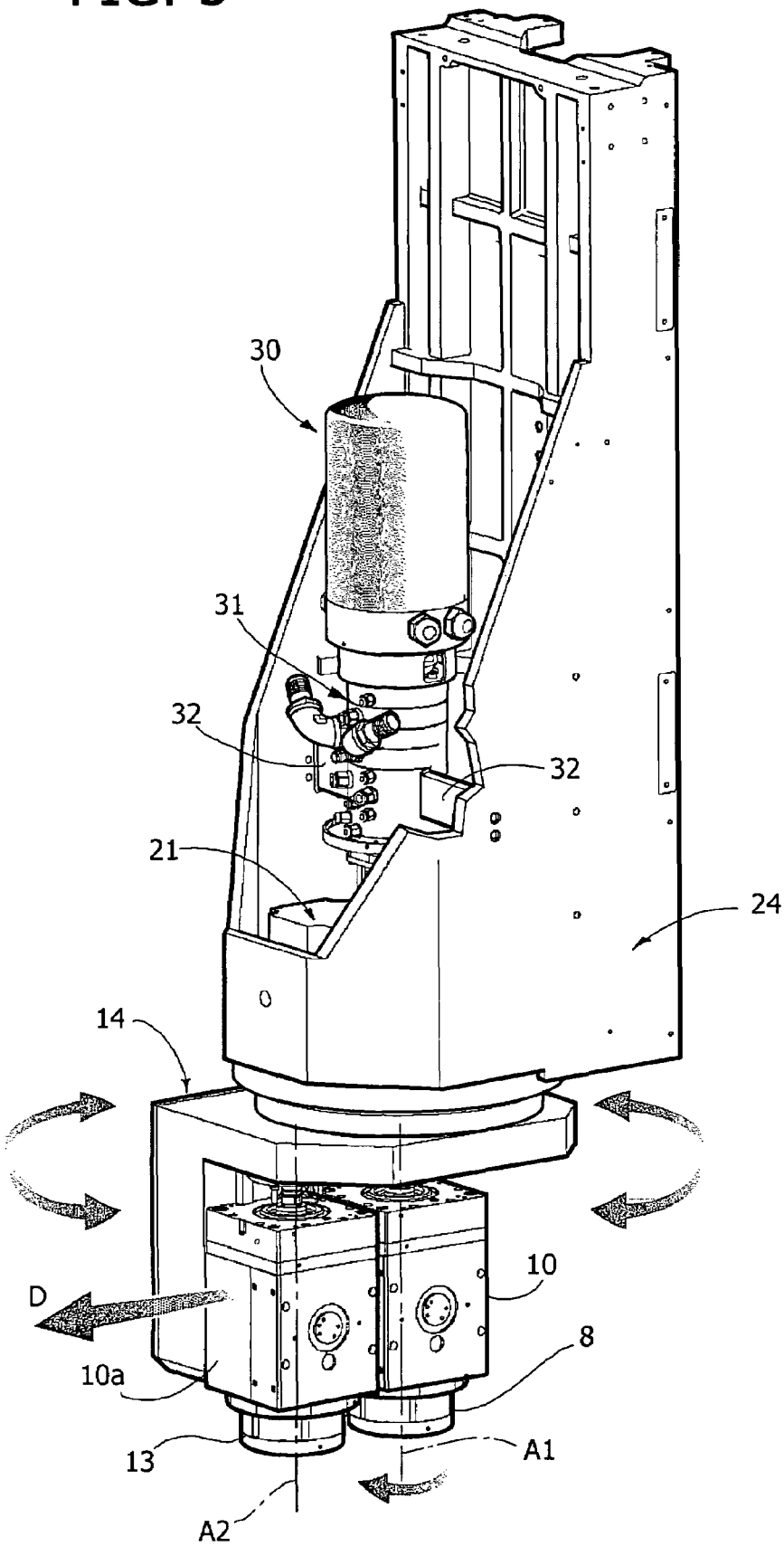
FIG. 5 is a view of a second and preferred version of the machining heads.
Figure 6:
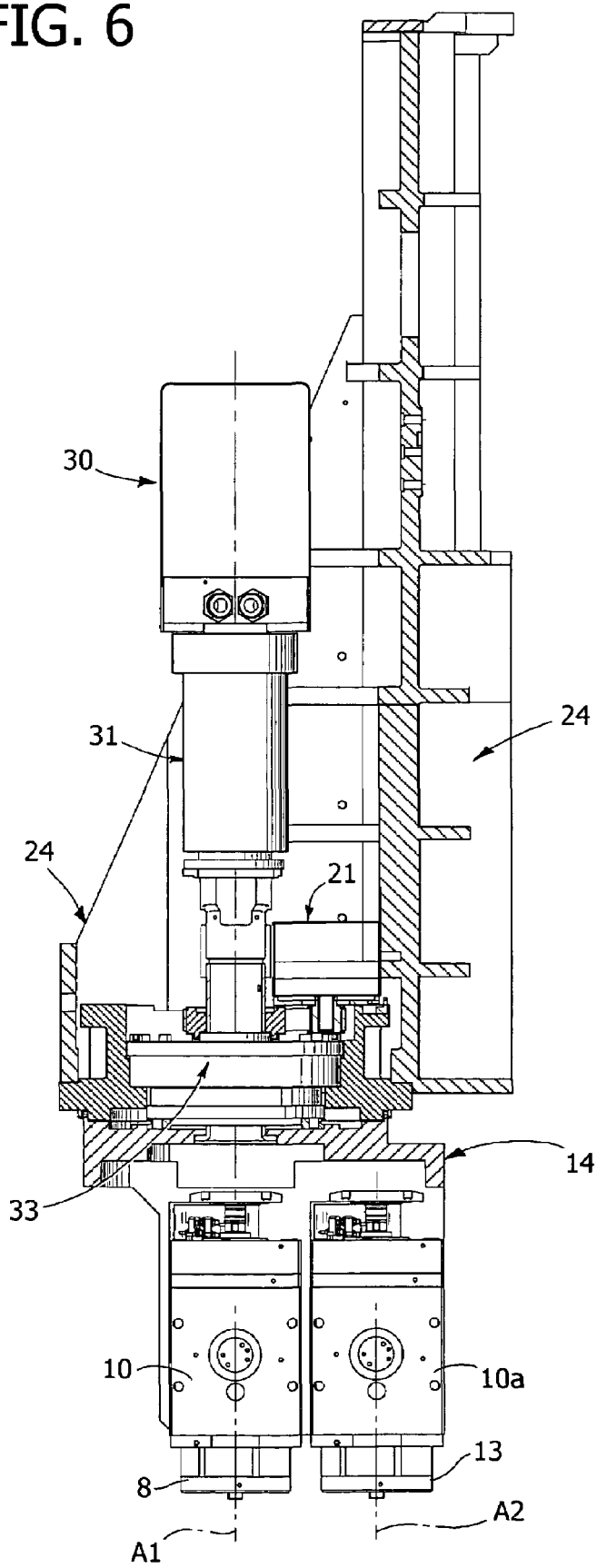
FIG. 6 is a cross-sectional view of the machining heads of FIG. 5.

In a second embodiment, illustrated in FIGS. 5 and 6, the means for controlling rotation of the auxiliary spindle 13 comprise a second electric motor 10*a*, which is independent of the first electric driving motor 10 and is associated to the auxiliary spindle 13.

Figure 3A:
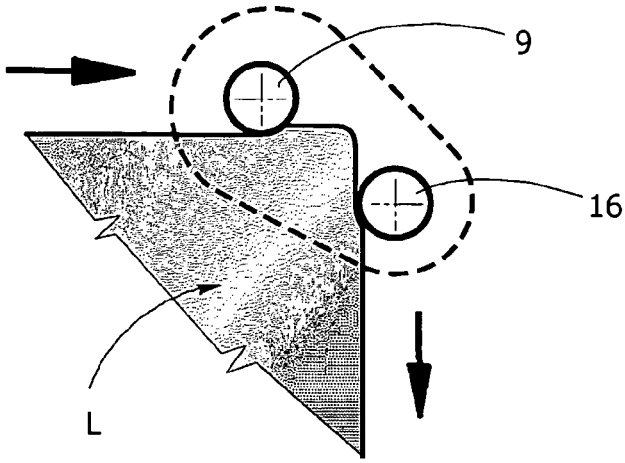
FIG. 3A is a schematic plan view that shows the movement of the machining heads on a plate.

With reference to the example of embodiment illustrated in the figures, the control means are prearranged so as to bring about the consecutive movement of the auxiliary tool 16 and of the first machining tool 9 along the edge of the plate, keeping the auxiliary tool 16 in a first position in the direction of displacement of the machining heads. In this way, the auxiliary tool 16 executes the first pass along the edge of the plate L (see FIG. 3A).

In a preferred embodiment, the means for controlling rotation of the auxiliary spindle 13 are designed to impart upon the auxiliary spindle 13 a speed of rotation as a function of the fixed transmission ratio, which determines the speed of rotation of the first spindle 8.

With particular reference to FIG. 4, the means for controlling rotation of the auxiliary spindle 13 comprise a first pulley 17, fitted on the first spindle 8, which transmits rotation via a belt 18 to a second pulley 19, fitted on the auxiliary spindle 13.

Once again with reference to FIG. 4, the auxiliary motor means 20, designed to control the angular position of the second machining head 11 with respect to the axis A1, comprise: a motor 21, carried by the first supporting structure 12; and a first pinion 21*a*, associated to the motor 21, which meshes with a second pinion 21*b* which transmits rotation through a shaft 21*c* to a second pinion 22. The pinion 22 meshes with an internal crown wheel 23, fixed with respect to the auxiliary supporting part 14 of the second machining head 11. In this way, by controlling the motor 21, the angular position of the second machining head with respect to the axis A1 is controlled.

The spindle 8 has a conical mouth 26 designed to receive a tapered shank 27 of a machining tool 9.

Means for clamping the tapered shank 27 within the conical mouth 26 are provided, which can be made in any known way.

The auxiliary supporting part 14 carries the auxiliary spindle 13 oriented with its axis A2 vertical and parallel to the axis A1 of the first spindle 8.

The spindle 13 is mounted so that it can turn within the auxiliary supporting part 14, and also in this case rolling bearings 22 are provided. Also in this case, the auxiliary spindle 13 has a conical mouth 26 designed to receive within it a tapered shank 27 of a machining tool 16.

With reference to FIGS. 5 and 6, the auxiliary supporting structure 14 carries the two electrospindle assemblies 8, 10 and 13, 10*a*. The motor 21 controls rotation of the structure 14 about the axis A1, transmitting rotation with a step-down gearing 33. The fixed external part of an electric coupling 30 and of a fluid coupling 31 is supported by brackets 32, connected to the slide 24. The electric coupling 30 and the fluid coupling 31 respectively enable electric power supply for the two motors and hydraulic power supply for the cooling nozzles 34 (more clearly visible in FIG. 4) necessary for directing the water during machining. The couplings moreover enable passage of the supply for the compressed air used for clamping and release of the machining tools within the spindles.

In a variant, it is possible to envisage that the second machining head 11 is mounted in a displaceable way with respect to the first machining head 7 in a direction orthogonal to the axes A1, A2 of rotation of the spindles, for regulating the distance between said axes A1, A2. In this case, it is possible to envisage motor means or manual-control means for regulation of the aforesaid distance between centres. For example, it is possible to envisage the presence of a slide (not illustrated) that enables translation of the auxiliary electrospindle 10*a*, 13 with respect to the first electrospindle 8, 10. With reference to FIG. 5, this possibility is indicated schematically by the arrow D, which indicates the direction of translation that can be imparted upon the head 11.

The electronic means for controlling the work-centre typically comprise an electronic control unit associated to means that enable storage of a predetermined profile of the plate L, for moving the first machining head 7 so that the first machining tool 9 follows said predetermined profile. For each position of the first machining head 7, the angular position that the second machining head 11 is to assume with respect to its axis of rotation A1 is determined so that the auxiliary tool 16 is in contact with a portion of the aforesaid predetermined profile. The motor 21 controls the angular position of the second machining head 11 so that it is always in contact with the portion of the predetermined profile.

Preferably, the position of the first machining head 7 and the position of the second machining head 11 are calculated in order to ensure a desired contact pressure of the first tool and of the auxiliary tool against the edge of the plate.

There are moreover provided sensor means for detecting the wear of the first tool and of the auxiliary tool during operation. Said means for detecting the wear of the tools consequently control the means for controlling the position of the two machining heads in order to guarantee maintenance of the desired pressure of contact of the tools against the edge of the plate, notwithstanding the wear of the tools. The aforesaid sensor means can measure the electrical current absorbed by the motors for controlling the spindles during operation and consequently provide closed-loop and real-time control of the position of the tools.

The work-centre according to the present invention does not, on the other hand, present the drawbacks that are characteristic of the known art. In this case, with one and the same movement of the carriage and/or of the cross-member of the work-centre, two machining passes are performed simultaneously. In the examples illustrated, the second machining head, which carries the auxiliary tool, executes the first pass, whilst the first machining head, which carries the first spindle, executes the second pass, thus obtaining an advantageous saving in time; however, the possibility of moving the two machining heads in reverse order is not ruled out.

Furthermore, the possibility of envisaging more than two machining heads in order to obtain the consecutive passing of more than two tools along the edge of the plate is not ruled out either.

Of course, without prejudice to the principle of the invention, the details of construction and the embodiments may vary widely with respect to what is described and illustrated herein, without thereby departing from the scope of the present invention, as defined by the ensuing claims.

What is claimed is:

1. A work-centre for machining the edge of plates of glass, stone, marble or the like, comprising:

a bench, defining a work surface, designed to receive the plates to be machined;

two fixed side members, set at the two sides of the work surface;

an overhead cross-member, guided over the two side members, in a horizontal direction Y orthogonal to the horizontal direction X of the cross-member;

a carriage, which is mobile in the aforesaid horizontal direction X on the cross-member;

a first machining head, mounted on a slide, which is mobile on the carriage in a vertical direction Z, said first machining head being equipped with a rotating spindle, which can be coupled to a machining tool, and with the corresponding electric driving motor;

first, second, and third motor means for controlling the cross-member, of the carriage, and of the slide along the axes Y, X, and Z, respectively; and electronic means for controlling said first, second, and third motor means and the electric driving motor of the aforesaid spindle, said work-centre being characterized in that:

the slide mounted on the carriage moreover carries at least one second machining head, which is mounted on said slide in cantilever fashion, and pivotally with respect to the axis of the spindle of the first machining head;

the second machining head has an auxiliary rotating spindle having an axis substantially parallel to the axis of the spindle of the first machining head and set at a distance therefrom, said auxiliary spindle being coupleable to an auxiliary machining tool;

means are provided for controlling rotation of the auxiliary spindle;

auxiliary motor means are provided, which control the angular position of the second machining head with respect to the axis of the first spindle; and the aforesaid electronic control means are designed to control also the aforesaid auxiliary motor means and are programmable so that during machining of the edge of a plate the consecutive passing of the first tool and of the auxiliary tool is obtained, in any order, along the edge of the plate with one and the same movement of the carriage and/or of the cross-member of the work-centre, and so that for each position of the first machining head along said edge, the angular position assumed by the second machining head with respect to the axis of the first spindle is such that said second machining head is in contact with said edge.

2. The work-centre according to claim 1, wherein the aforesaid means for controlling rotation of the auxiliary spindle comprise a mechanical drive controlled by the electric motor for controlling the first spindle.

3. The work-centre according to claim 1, wherein the aforesaid means for controlling rotation of the auxiliary spindle comprise an independent electric motor associated with the auxiliary spindle.

4. The work-centre according to claim 1, wherein the control means are provided for bringing about the aforesaid consecutive movement of the first tool and of the auxiliary tool along the edge of the plate, keeping the auxiliary tool in a first position in the direction of displacement, so as to get it to execute the first pass along the edge of the plate.

5. The work-centre according to claim 4, wherein the aforesaid means for controlling rotation of the auxiliary spindle are designed to impart upon the auxiliary spindle a speed of rotation as a function of the transmission ratio set.

6. The work-centre according to claim 4, wherein the aforesaid means for controlling rotation of the auxiliary spindle are designed to impart upon the auxiliary spindle a speed of rotation that is independent of the speed of rotation of the first spindle.

7. The work-centre according to claim 2, wherein:

the first machining head comprises a first supporting structure carried by the slide, mounted on the carriage of the work-centre, which carries the electric motor for controlling the first tool, oriented with its axis vertical, the first spindle also being vertical and mounted within a cylindrical supporting part of the first supporting structure;

the second machining head, which carries the auxiliary spindle, comprises an auxiliary supporting part, mounted in cantilever fashion on the first supporting structure, pivotally about the axis of the first spindle; and the aforesaid means for controlling rotation of the auxiliary spindle comprise a first pulley, which is fitted on the first spindle and transmits rotation via a belt to a second pulley, fitted on the auxiliary spindle.

8. The work-centre according to claim 7, wherein:

said auxiliary motor means that control the angular position of the second machining head with respect to the axis of the first spindle comprise a motor carried by the first supporting structure, which drives a pinion meshing with a crown wheel fixed with respect to the aforesaid auxiliary supporting part of the second machining head.

9. The work-centre according to claim 1, wherein the second machining head is mounted in a displaceable way with respect to the first machining head in a direction orthogonal to the axes of rotation of the spindles for regulating the distance between said axes.

10. The work-centre according to claim 1, wherein means are provided for:

storing a predetermined profile of the plate to be machined;

moving the first machining head so that the first tool of the first machining head follows said predetermined profile;

for each position of the first machining head, determining the angular position that the second machining head is to assume with respect to its axis of rotation so that the auxiliary tool is in contact with a portion of the aforesaid predetermined profile; and consequently controlling the position of said second machining head.

11. The work-centre according to claim 10, wherein means are provided for determining the position of the first machining head and the position of the second machining head in order to ensure a desired contact pressure of the first tool and of the auxiliary tool against the edge of the plate.

12. The work-centre according to claim 11, wherein means are provided for detecting the wear of the first tool and of the auxiliary tool during operation, and means are provided for consequently controlling the pressure of the first machining head and of the second machining head in order to guarantee maintenance of the desired contact pressure of the tools against the edge of the plate, notwithstanding the wear of the tools.

13. The work-centre according to claim 12, wherein means are provided for detecting the wear of the tools by measuring the electrical current absorbed by the motor means for controlling rotation of the tools.

14. A method for machining plates of glass, stone, marble or the like, which envisages providing a work-centre comprising:

a bench, defining a work surface designed to receive the plates to be machined;

two fixed side members, set at the two sides of the work surface;

an overhead cross-member guided over the two side members, in a horizontal direction Y orthogonal to the horizontal direction X of the cross-member;

a carriage, which is mobile in the aforesaid horizontal direction X on the cross-member; and a first machining head carried by a slide, mounted mobile on the carriage in a vertical direction Z and equipped with a rotating spindle, which can be coupled to a machining tool and to the corresponding electric driving motor, said method moreover envisaging the step of controlling displacement of the cross-member, the carriage, and the slide along the axes Y, X, and Z, respectively, said method being characterized in that it moreover comprises the steps of:

providing at least one second machining head, carried by the slide and supported pivotally about the axis of the spindle of the first machining head;

providing the second machining head with an auxiliary rotating spindle having an axis substantially parallel to the axis of the spindle of the first machining head and set at a distance therefrom, said auxiliary spindle being coupleable to an auxiliary machining tool;

controlling rotation of the auxiliary spindle; and controlling the angular position of the second machining head with respect to the axis of the first spindle so that, during machining of the edge of a plate, the consecutive passing of the first tool and of the auxiliary tool are obtained, in any order, along the edge of the plate with one and the same movement of the carriage and/or of the cross-member of the work-centre.

15. The method according to claim 14, wherein:

a predetermined profile of the plate to be machined is stored;

the first machining head is moved so that the first tool of the first machining head follows said predetermined profile;

for each position of the first machining head the angular position that the second machining head is to assume with respect to the axis of the first spindle is determined so that the auxiliary tool is in contact with a portion of the aforesaid predetermined profile; and the position of said second machining head is consequently controlled.

16. The method according to claim 15, wherein the position of the first machining head and the position of the second machining head are determined in such a way as to ensure a desired contact pressure of the first tool and of the auxiliary tool against the edge of the plate.

17. The method according to claim 16, wherein the wear of the first tool and of the auxiliary tool is detected during the operation, and the pressure of the first machining head and of the second machining head is consequently controlled in order to guarantee maintenance of the desired contact pressure of the tools against the edge of the plate, notwithstanding the wear of the tools.

18. The method according to claim 17, wherein the wear of the tools is detected by means of the measurement of the electrical current absorbed by the motor means for controlling rotation of the tools.

* * * * *